US011767842B2

(12) United States Patent
Kamada et al.

(10) Patent No.: US 11,767,842 B2
(45) Date of Patent: Sep. 26, 2023

(54) ELECTRIC PUMP ACTUATOR, STEPLESS TRANSMISSION WITH ELECTRIC PUMP ACTUATOR AND CONTROL METHOD FOR AN ELECTRIC PUMP ACTUATOR

(71) Applicant: Schaeffler Technologies AG & Co. KG, Herzogenaurach (DE)

(72) Inventors: Shinobu Kamada, Kawasaki (JP); Masahiro Toriumi, Kawasaki (JP); Takao Miyazaki, Saitama (JP); Keiju Abo, Yokohama (JP)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 333 days.

(21) Appl. No.: 16/606,851

(22) PCT Filed: May 3, 2018

(86) PCT No.: PCT/DE2018/100427
§ 371 (c)(1),
(2) Date: Oct. 21, 2019

(87) PCT Pub. No.: WO2018/206050
PCT Pub. Date: Nov. 15, 2018

(65) Prior Publication Data

US 2021/0285442 A1 Sep. 16, 2021

(30) Foreign Application Priority Data

May 12, 2017 (DE) ..... 102017110394.5

(51) Int. Cl.
*F04C 2/26* (2006.01)
*F04C 15/00* (2006.01)

(52) U.S. Cl.
CPC ..... *F04C 2/26* (2013.01); *F04C 15/008* (2013.01); *F04C 2240/402* (2013.01); *F04C 2270/035* (2013.01)

(58) Field of Classification Search
CPC .... F04C 2/26; F04C 15/008; F04C 2240/402; F04C 2270/035; F04C 2/24; F04C 2270/03; F04C 18/24; F04C 18/26; F04C 29/0085
See application file for complete search history.

(56) References Cited

U.S. PATENT DOCUMENTS 4,895,552 A * 1/1990 Abo ..... F16H 37/021 474/18
6,219,608 B1 4/2001 Abo et al.
(Continued)

FOREIGN PATENT DOCUMENTS

CN 2071717 2/1991
CN 104364528 2/2015
(Continued)

*Primary Examiner* — Bryan M Lettman

(57) ABSTRACT

An electric pump actuator for a continuously variable transmission includes a gear wheel pump, a first electric motor, a second electric motor, and an electric control unit. The gear wheel pump has a first gear wheel and a second gear wheel meshing with the first gear wheel. The first electric motor is for actuating the first gear wheel, and the second electric motor is for actuating the second gear wheel independent of the first gear wheel. The electronic control unit is arranged to control the first electric motor to transmit a first torque to the first gear wheel, and control the second electric motor to transmit a second torque to the second gear wheel that is set against the first torque in at least one rotation angle range.

12 Claims, 4 Drawing Sheets

(56) References Cited

U.S. PATENT DOCUMENTS

| | | | | |
|---|---|---|---|---|
| 6,250,278 | B1 * | 6/2001 | Mekler | F01C 11/002 418/200 |
| 10,598,176 | B2 * | 3/2020 | Afshari | F04C 15/008 |
| 2010/0322806 | A1 * | 12/2010 | Aregger | F04C 2/18 418/2 |
| 2012/0019010 | A1 * | 1/2012 | Nakamura | F01C 13/04 290/1 R |
| 2013/0336808 | A1 * | 12/2013 | Wang | F04C 14/04 417/374 |
| 2015/0247498 | A1 * | 9/2015 | Afshari | F04C 2/08 418/1 |
| 2018/0266415 | A1 * | 9/2018 | Afshari | F04C 11/008 |
| 2018/0291895 | A1 * | 10/2018 | Afshari | F03C 1/0607 |

FOREIGN PATENT DOCUMENTS

| | | | |
|---|---|---|---|
| CN | 106568688 | | 4/2017 |
| EP | 0821187 | A2 | 1/1998 |
| EP | 2275684 | A1 | 1/2011 |
| WO | 00/12918 | A1 | 3/2000 |
| WO | 2012113368 | A2 | 8/2012 |
| WO | 2015/131196 | A1 | 9/2015 |
| WO | WO2015131196 | * | 9/2015 |

* cited by examiner

ELECTRIC PUMP ACTUATOR, STEPLESS TRANSMISSION WITH ELECTRIC PUMP ACTUATOR AND CONTROL METHOD FOR AN ELECTRIC PUMP ACTUATOR

CROSS-REFERENCE TO RELATED APPLICATIONS

This application is the United States National Phase of PCT Appln. No. PCT/DE2018/100427 filed May 3, 2018, which claims priority to German Application No. DE102017110394.5 filed May 12, 2017, the entire disclosures of which are incorporated by reference herein.

TECHNICAL FIELD

The present disclosure relates to an electric pump actuator (EPA) for a continuously variable transmission (CVT) in a motor vehicle, for example for a (CVT) transmission adjusting procedure or a contact pressure force controlling procedure. The EPA has a gear wheel pump with two meshing gear wheels, for example an external gear wheel pump that may have a spur toothing arrangement or helical toothing arrangement or spiral toothing arrangement in which the first gear wheel and the second gear wheel may be actuated independently by electric motors. The EPA also has an electronic control unit (ECU) for controlling a first one of the electric motors, which is designed to transmit a first torque to the first gear wheel, and for controlling a second one of the electric motors, which is designed to transmit a second torque to the second gear wheel. In addition, the disclosure relates to a continuously variable transmission having at least one electric pump actuator and also a control method for controlling an electric pump actuator.

BACKGROUND

U.S. Pat. No. 6,219,608 B1 discloses by way of example an electronic transmission adjusting procedure of a continuously variable transmission having two gear wheel pumps in which each gear wheel pump is operated respectively by means of an individual electric motor. The one gear wheel pump (clamp oil pump) in this case provides a continuous static pressure and as a consequence regulates the continuous contact pressure force in the hydraulic system, whereas the other gear wheel pump (shifting oil pump) controls the transmission adjusting procedure of a first shaft with respect to a second shaft or controls a pressure ratio between the respective contact pressure of two radially-grooved conical washers.

A control system for a continuously variable transmission is likewise disclosed in WO 00/12918 A1 and a hydraulic device for actuating a coupling arrangement is disclosed in WO 2012/113368 A2.

The publication WO 2015/131196 A1 discloses an electric pump actuator in the form of an external gear wheel pump having two gear wheels, having a first electric motor, which drives or actuates the first gear wheel, and a second electric motor, which drives the second gear wheel independently of the first gear wheel. In this case, the electric motors may either engage via a shaft on the respective gear wheel as well as be arranged in the gear wheel itself.

One problem in the case of the gear wheel pumps having only one individual electric motor is that in particular in the automobile the electrical voltage is provided via a car battery, which in general provides a voltage of 12 V. As a consequence, maximum permissible power using a standard electric cable may be limited to approximately 700 W. During a rapid shutdown procedure, such as by way of example in the event of an emergency braking procedure, the clamp oil pump, therefore the gear wheel pump, may require more than 1200 W with the result that a higher voltage is required. If therefore only one motor is used in the case of a gear wheel pump, a cost-intensive converter from 12 V to 24 V or to 36 V or to 48 V may be necessary.

Moreover, as a consequence of the fact that the gear wheel pump is operated using only one individual electric motor that is arranged on an outer side of the shifting oil pump, gear wheel noises are produced owing to a backlash of the gear wheels, which may be difficult to control. The uncontrolled gear wheel backlash likewise generates a rapid switch of a hydraulic flow and, for example, a return flow rate with the result that the hydraulic pressure oscillates, which is not desired. Owing to this phenomenon, it can be difficult to maintain the ratio or the hydraulic pressure as constant. Therefore, as is also proposed in the publication WO 2015/131196 A1, a dedicated electric motor is provided for each gear wheel of the gear wheel pump, wherein the two electric motors are individually connected to the first or the second gear wheel of the gear wheel pump and both are driven using said electric motors. The first gear wheel is therefore rotated independently of the second gear wheel, however the problem of a possible leakage and an unstable and oscillating pressure remains.

SUMMARY

Example aspects broadly comprise an electric pump actuator, a continuously variable transmission and also a control method for an electric pump actuator that stabilizes the hydraulic pressure at a relatively constant level, that realizes a relatively stable flow rate, and that avoids or at least reduces a return flow owing to a backlash between the two gear wheels and that may be reliably operated. This power increase is to be achieved without it being necessary to use expensive gear wheels or expensive mechanical components. For example, a return flow between the gear wheels at a low rate of rotation of the gear wheels is to be reduced since owing to the fluid-mechanical opening or leakage for a longer time frame/period a larger volume may flow back than would be the case at a high rotational speed. It is also to be avoided that the efficiency of an electric pump actuator decreases owing to an improved precision of the gear wheels since friction also usually increases between the gear wheels as a result of the higher precision with less available play. The disclosure involves reducing the return flow in order to improve the power in a cost-effective production and assembly procedure.

An electric pump actuator in accordance with the disclosure in accordance with the generic type is achieved by virtue of the fact that the electronic control unit (ECU) controls the first electric motor and the second electric motor in such a manner that the torque vectors prescribe same rotation directions of the gear wheels. In other words, this means that, for example, in the range in which the gear wheels mesh, the force that results from/is due to the second torque M2 is set against any force that results from/is due to the first torque M1 in at least one rotation angle section. In contrast with the known prior art, not only a torque at which the resulting forces are added to one another and are therefore not opposing one another is provided to the two electric motors respectively, but at least in terms of the rotation angle section the resulting forces of the two torques M1 and M2 are also opposed to one another/act against one another/act in an opposing directions. By virtue of the fact that such a torque is applied respectively to the two gear wheels of the electric pump actuator and that the resulting forces oppose one another, it is possible to efficiently reduce and even prevent a leakage.

An individual tooth of the one gear wheel of the gear wheel pump lies against the tooth of the opposite-lying gear wheel when the gear wheels rotate owing to the opposing forces that result from the torques, said individual tooth preventing a leakage and closing a return flow of the hydraulic medium/fluid. The time of a return flow or a fluid-technical opening is reduced owing to the active support by means of the accordingly applied torques. As a consequence, a stabilizing procedure of the conveying power or the flow rate of the electronic pump actuator is achieved and a stable pressure may be ensured.

In an example embodiment of the electric pump actuator, the electronic control unit (ECU) may control the first and the second electric motor in such a manner that the absolute value of the first torque M1 is greater than the absolute value of the second torque M2 and the two absolute values may be maintained as constant. In another example embodiment, the electronic control unit controls the first electric motor and the second electric motor in such a manner that, in the first predetermined rotation angle ranges of the gear wheels, the absolute value of the first torque M1 adopts a constant absolute value while simultaneously the absolute value of the second torque M2 is lower than the absolute value of the first torque M1, and, in the second predetermined rotation angle ranges of the gear wheels, the first torque M1 adopts an absolute value that is greater than the constant absolute value of the first predetermined rotation angle ranges and the absolute value of the second torque M2 remains lower than the absolute value of the first torque M1 but greater than the absolute value of the second torque M2 of the first rotation angle range.

In this case, the first electric motor therefore generates a drive torque with a corresponding resulting force, whereas the second electric motor applies a torque with a corresponding opposing resulting force. The second gear wheel is actively rotated and driven by means of the first gear wheel on account of the two gear wheels meshing and of the higher absolute value of the first torque of the first gear wheel with respect to the absolute value of the second torque of the second gear wheel. In the first variant above, the first electric motor is controlled therefore by means of the electronic control unit in such a manner that the absolute value of the first torque is always greater than the absolute value of the second torque, which the second electric motor transmits to the second gear wheel. The second gear wheel is actively and rapidly "rotated back" when meshing into the first gear wheel and the teeth of the two gear wheels are actively pressed against one another in order to prevent a return flow and to stabilize a pressure.

In the second variant above, the electronic control unit controls the first and the second electric motor in such a manner that, in the first predetermined rotation angle ranges/rotation angle sections, the first electric motor transmits the constant absolute value of the first torque to the first gear wheel while simultaneously the absolute value of the second torque is lower than the absolute value of the first torque. For example, the absolute value of the second torque in the first predetermined rotation angle ranges is zero, so the second electric motor is therefore passive. In the first predetermined rotation angle ranges, the required power of the electric pump actuator may be reduced since, in the first predetermined rotation angle ranges, the teeth of the two gear wheels still lie against one another with the result that also a leakage does not occur here. In the second predetermined rotation angle ranges of the gear wheels, which lie between the first rotation angle ranges and are the rotation angle ranges in which an active stabilizing procedure of the flow rate of the electric pump actuator or an active suppression of the leakage is necessary, the absolute value of the first torque that the first electric motor transmits to the first gear wheel, increases with respect to the constant absolute value of the first predetermined rotation angle ranges.

The second electric motor transmits a second torque to the second gear wheel, the absolute value of said second torque remaining lower than the absolute value of the first torque of the second rotation angle range but being greater than the absolute value of the second torque in the first rotation angle range. The two gear wheels are therefore actuated actively and independently of one another and are controlled in the periods/time sections of a leakage that occurs by means of the electronic controller (ECU) in such a manner that the time of an undesired fluid-technical connection and a return flow is minimized and a leakage is accordingly reduced and even prevented.

The electric pump actuator may be designed in such a manner that the value or delta amount/delta value/difference value by which the electronic control unit increases the absolute value of the first torque with respect to the constant absolute value is identical to the delta amount by which the absolute value of the second torque is increased. The two torques are therefore increased by the same absolute value. Owing to the interaction of the two gear wheels of the electric pump actuator, the resulting force of the second torque opposes the resulting force of the first torque, despite the fact that the absolute value of a total torque as a sum of the absolute value of the first torque minus the absolute value of the second torque remains constant. This absolute value of the total torque corresponds, in particular, to an absolute value of a torque, which normally would comprise a customary electric pump actuator having an individual motor for a continuously variable transmission.

The electric pump actuator may include two inverters for the first and the second electric motor respectively, said inverters converting a direct current voltage, in particular that of a 12 V battery such as, for example a car battery, into an alternating current voltage and providing the alternating current voltage via the electronic control unit in a controlled manner to the first and the second electric motor respectively. The first electric motor and the second electric motor may be actuated by providing the alternating current or alternating current voltage with, for example, three phases. On the one hand, it is possible to vary the power and, on the other hand, it is possible to determine the direction in which the electric motor is to rotate. The electronic control unit may thus control the electric pump actuator in a cost-effective and efficient manner.

The electric pump actuator may comprise multiple, e.g., two, first electric motors for actuating purposes that engage on the first gear wheel and/or multiple, e.g., two, second electric motors for actuating purposes that engage on the second gear wheel. It is possible by means of multiple electric motors on the first and/or second gear wheel to achieve an even higher power and/or precise control of the electric pump actuator. The multiple first electric motors or multiple second electric motors may be actuated identically via the electronic control unit.

For example, the electric pump actuator may comprise respective electric motor-generators as first and second electric motors, said electric motor-generators being designed so as to also convert mechanical energy into electrical energy in addition to converting electrical energy into mechanical energy and said motor-generators are designed so as to provide said energy to the (electric) system of the electric pump actuator. For example, the first electric motor-generator may thus be controlled in such a manner that said motor-generator actively drives the gear wheel pump in a drive mode and functions as an electric motor for which said motor-generator requires a high power, whereas the second electric motor-generator in fact applies a torque to the second gear wheel, the absolute value of said torque however being lower than the absolute value of the first torque with the result that the second gear wheel is driven and the second electric motor-generator that is attached functions as a generator. In the generator mode, the mechanically-driven second electric motor-generator provides the power that is generated to the first electric motor.

Any disclosure in conjunction with the electric pump actuator for a continuously variable transmission also applies for the control method for an electric pump actuator. Likewise any disclosure in conjunction with the control method for an electronic pump actuator applies for an electric pump actuator for a continuously variable transmission.

A control method in accordance with the generic type for an electric pump actuator having two meshing gear wheels, and an electronic control unit for controlling an at least one first electric motor and at least one second electric motor, includes: applying a first torque M1 to the first electric motor; and applying a second torque M2 to the second electric motor, wherein the torque vectors of the first torque M1 and of the second torque M2 comprise the same direction or point in the same direction and preferably lie parallel to one another. The control method therefore controls the electric motors in such a manner that the forces that result from the two torques M1 and M2 oppose one another.

The absolute values of the two torques M1, M2 may be maintained as constant, wherein the absolute value of the first torque M1 is greater than the absolute value of the second torque M2, for example, or the absolute values of the two torques M1, M2 may vary when seen over the rotation angle range and increased at the same point in time, by way of example, by the same amount. As a consequence, the control method controls the electric motors in such a manner that the electric pump actuator substantially prevents undesired return flow.

A delta amount by which the absolute value of the first torque M1 is increased may be identical to the delta amount by which the absolute value of the second torque M2 is increased. As a consequence, a total torque as a sum of the two torques, or the absolute value of the first torque minus the absolute value of the second torque, remains the same.

A continuously variable transmission (CVT) in accordance with the generic type for a vehicle uses (at least) one electric pump actuator in accordance with the disclosure. A CVT transmission adjusting procedure or a contact pressure force controlling procedure can be assumed by an electric pump actuator in accordance with the disclosure. For example, two electric pump actuators can be used, namely both as a CVT transmission adjusting procedure as well as a contact pressure force controlling procedure. Surprisingly, a more reliable and more stable operation is already ensured by means of this use of two electric pump actuators.

In other words, the disclosure relates to an electric pump actuator (EPA) for a continuously variable transmission (CVT) in lieu of a fully hydraulic system. In order to stabilize the CVT (transmission) ratio by means of reducing the return flow and in order to improve the power it is proposed to use gear wheel pumps that are driven by at least two, e.g., 12V, electric motors having two different axles, which may be used for the CVT transmission adjusting procedure or the contact pressure force controlling procedure. If a higher power, by way of example over 1000 W, is required for the electric pump actuator, multiple (12V) electric motors may be used. The electric motors are controlled in such a manner that the first torque is applied to the first electric motor and the second torque is applied to the second electric motor, said second torque in at least one rotation angle section/rotation angle range being set against or opposing the resulting forces.

For example, during the CVT transmission adjusting procedure, the electronic control unit generates a "command torque" in order to operate the shifting oil pump/shifting pump or adjusting oil pump/adjusting pump and a torque distributor that distributes a command torque between the electric motors in the shifting oil pump. The two electric motors for the electric pump actuator are "operated in different (counteracting) directions" such as a drive torque on one side and a regenerative torque or opposing torque on the other side, or in the same direction of the torque vectors. The first electric motor that generates the drive torque is, for example, (electrically) supported by the second electric motor, which generates the regenerative torque. The torque distributor causes a preceding or a delayed phase on at least one side using the corresponding electric motors.

BRIEF DESCRIPTION OF THE DRAWINGS

The disclosure is further explained below with reference to exemplary embodiments with the aid of figures. In the drawings.

DETAILED DESCRIPTION

Figure 1:
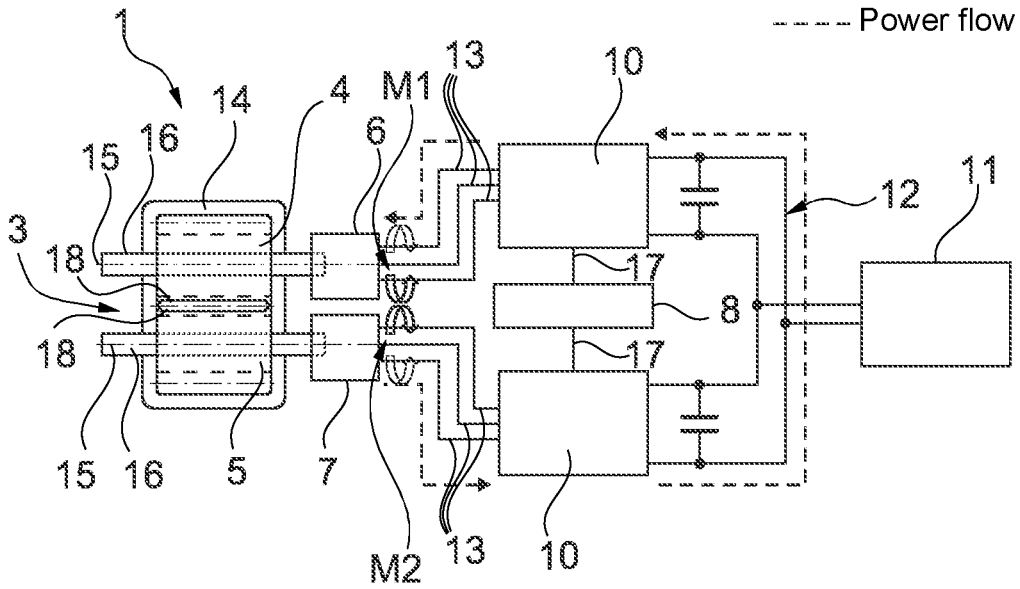
FIG. 1 illustrates schematically a view of an example embodiment of an electric pump actuator for a continuously variable transmission.

The figures are schematic in nature and are only to be used to facilitate the understanding of the invention. Identical elements are provided with the same reference numerals. The features of the different embodiments are interchangeable.

Figure 2:
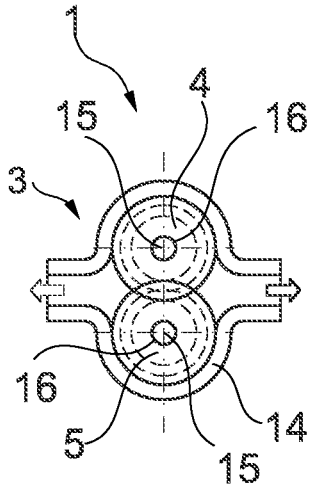
FIG. 2 illustrates a sectional view of the electric pump actuator in FIG. 1.
Figure 6:
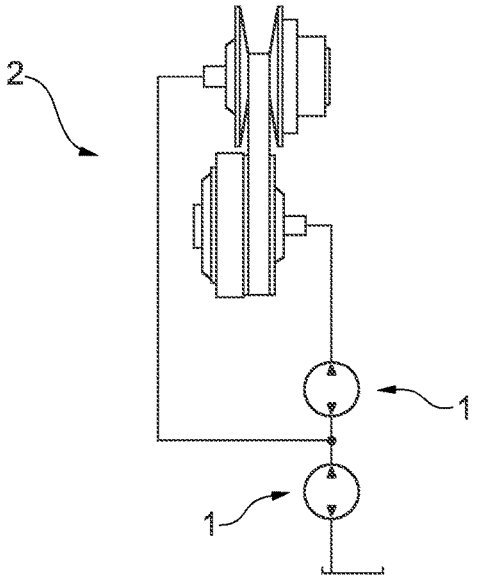
FIG. 6 illustrates schematically a continuously variable transmission having a CVT transmission adjusting procedure and a contact pressure force controlling procedure.

FIG. 1 and FIG. 2 illustrate an electric pump actuator (EPA) 1 for a continuously variable transmission (CVT) 2 (ref. FIG. 6), for a CVT transmission adjusting procedure, or for a contact pressure force controlling procedure. FIG. 1 illustrates the corresponding longitudinal section through the electric pump actuator 1 and FIG. 2 illustrates the corresponding cross section. The electric pump actuator 1 comprises an external gear wheel pump 3 having a spur toothing arrangement having two meshing gear wheels 4 and 5 in which the first gear wheel 4 may be actuated via a first electric motor 6 independently of the second gear wheel 5 via a second electric motor 7. The two electric motors 6, 7 are electric motor-generators.

The first electric motor 6 is designed so as to transmit a first torque M1 to the first gear wheel 4 and the second electric motor 7 is designed so as to transmit a second torque M2 to the second gear wheel 5 accordingly. An electronic control unit (ECU) 8 in this case controls the two electric motors 6, 7 in such a manner that via meshing the two gear wheels 4, 5, the force that results from the second torque M2 is set against any force that results from the first torque M1 in at least one rotation angle section 9 (cf. FIGS. 7-9). The torque vectors (pointing in the same direction) of the torques M1, M2 in this case prescribe identical rotation directions of the gear wheels 4, 5 (cf. bottom of FIG. 7).

The electric pump actuator 1 comprises, for the control of the two electric motors 6, 7, two inverters 10, which convert a direct current voltage of a conventional car battery 11, in this case a 12 V lead acid battery, into a three-phase alternating current in order to accordingly control and actuate the two electric motors 6, 7. The two inverters 10 are connected electrically on one side via direct current lines 12 to the battery 11, and on the other side via respectively three alternating current lines 13 to the first and second electric motors 6 and 7. Control lines 17 for actuating purposes connect the ECU 8 to the inverters 10. The two gear wheels 4, 5 are mounted in a housing 14, which may be produced from metal or a synthetic material, and are accordingly sealed with respect to fluids from the outside, to the supply ducts and discharge ducts, via shafts 16, which extend coaxially to rotary axles 15 of the gear wheels 4, 5. The rotary axles 15 of the two gear wheels 4, 5 in this case lie parallel to one another and the gear wheels 4, 5 essentially lie in a plane with the result that their teeth 18 (cf. also FIG. 7) engage in one another and are in operative engagement. The first electric motor 6 generates the torque M1, the absolute value of said first torque being higher than the absolute value of the torque M2 with the result that the second electric motor 7 is operated as a generator and provides an electric power to the first electric motor 6. This is illustrated for clarity with the dashed lines as the power flow.

Figure 3:
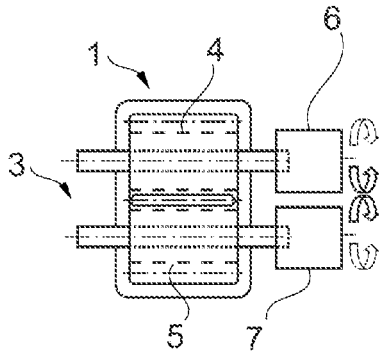
FIG. 3 illustrates schematically a sectional view of the electric pump actuator in FIG. 1 and FIG. 2 having two electric motors on one side.
Figure 4:
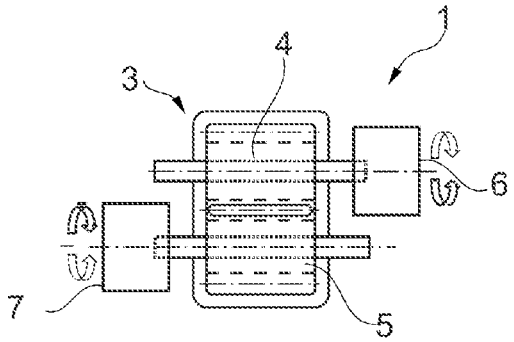
FIG. 4 illustrates schematically a sectional view of an electric pump actuator of a further example embodiment or configuration having a motor on each side.
Figure 5:
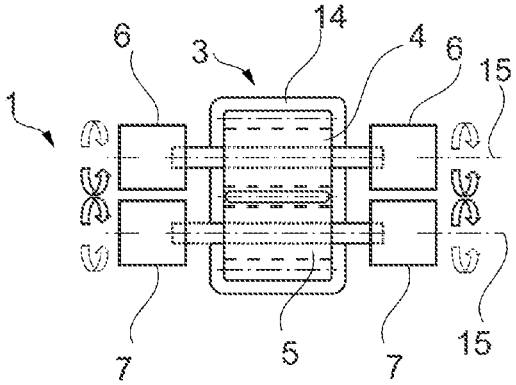
FIG. 5 illustrates schematically a sectional view of an electric pump actuator of a further example embodiment or configuration having two motors on each side.

FIGS. 3-5 illustrate different configurations of an electric pump actuator 1 in accordance with different embodiments. FIG. 3 illustrates the configuration in accordance with the first example embodiment (cf. FIGS. 1 and 2) having two separate electric motors 6, 7 that are arranged on the same side of the gear wheel pump 3 (on the right-hand side in FIG. 3). The right-hand side part of FIG. 1, therefore the electronic system, for the sake of clarity has not been illustrated. FIG. 4 illustrates an electric pump actuator 1 of a further embodiment or configuration, wherein the electric motors 6, 7 are arranged on different sides (in FIG. 4 on the left-hand side and right-hand side) of the gear wheel pump 3. FIG. 5 illustrates a further embodiment of an electric pump actuator 1 having four separate electric motors 6, 7 or two first electric motors 6 and two second electric motors 7, which accordingly engage on the respective rotary axle 15 of the gear wheels 4, 5, wherein two electric motors 6, 7 are respectively arranged on one side.

FIG. 6 illustrates schematically a first embodiment of a continuously variable transmission 2 having an electric pump actuator 1 that is used for a CVT transmission adjusting procedure and an electric pump actuator 1 that is used for a contact pressure force controlling procedure. The lower (cf. FIG. 6) electric pump actuator 1 is used mainly for the purpose of providing a relatively constant pressure to the continuously variable transmission 2 for a defined contact pressure force controlling procedure, whereas the other electric pump actuator 1 is used as a CVT transmission adjusting procedure and accordingly regulates a transmission ratio by means of the different contact pressure forces on the first CVT shaft and the second CVT shaft. In the case of this embodiment, only one individual battery 11 is necessary. A main controller accordingly controls the electronic control units 8 of the two electric pump actuators 1. Alternatively, the two separate electronic control units 8 may also be integrated into a single main controller.

The electronic control unit 8 of the first embodiment of the electric pump actuator 1 is controlled according to a control method for the electric pump actuator 1 and is explained below together with the electric pump actuator 1.

Figure 7:
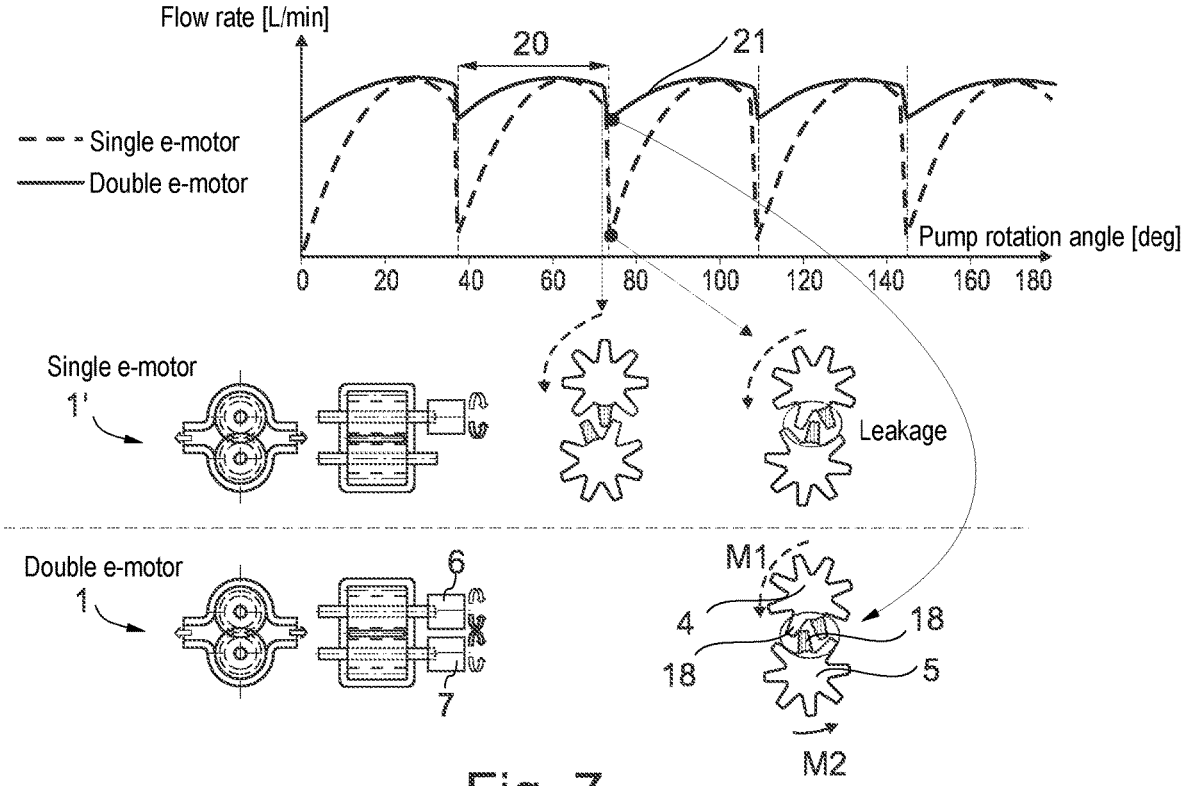
FIG. 7 illustrates a diagram, which illustrates the difference between a conventional electric pump actuator and the electric pump actuator in accordance with the first embodiment and also the control of the electronic control unit in dependence upon the rotation angle of the electric pump actuator.

FIG. 7 illustrates in a diagram a comparison of a conventional electric pump actuator 1' (dashed line), which comprises an individual electric motor (individual E-motor), with an electric pump actuator 1 (solid line, double E-motor) in which the ECU 8 controls the first and second electric motor 6, 7 as described above. This control forms the basis of the control method for an electric pump actuator.

The first and the second gear wheel 4, 5 comprise respectively the same number of teeth 18, as a result of which for an individual tooth segment a period/a specific period angle 20 of, in this case, 36° occurs in the case of an entire rotation of 360°. In this period 20 or this period angle 20, as is apparent with reference to the upper diagram in FIG. 7, a curve of a flow rate 21 and also an engagement of the gear wheels 4, 5 repeats. In the figure, eight teeth 18 are illustrated per gear wheel 4 or 5. Ten teeth 18 would however be suitable for the diagram that is illustrated at the top.

Figure 8:
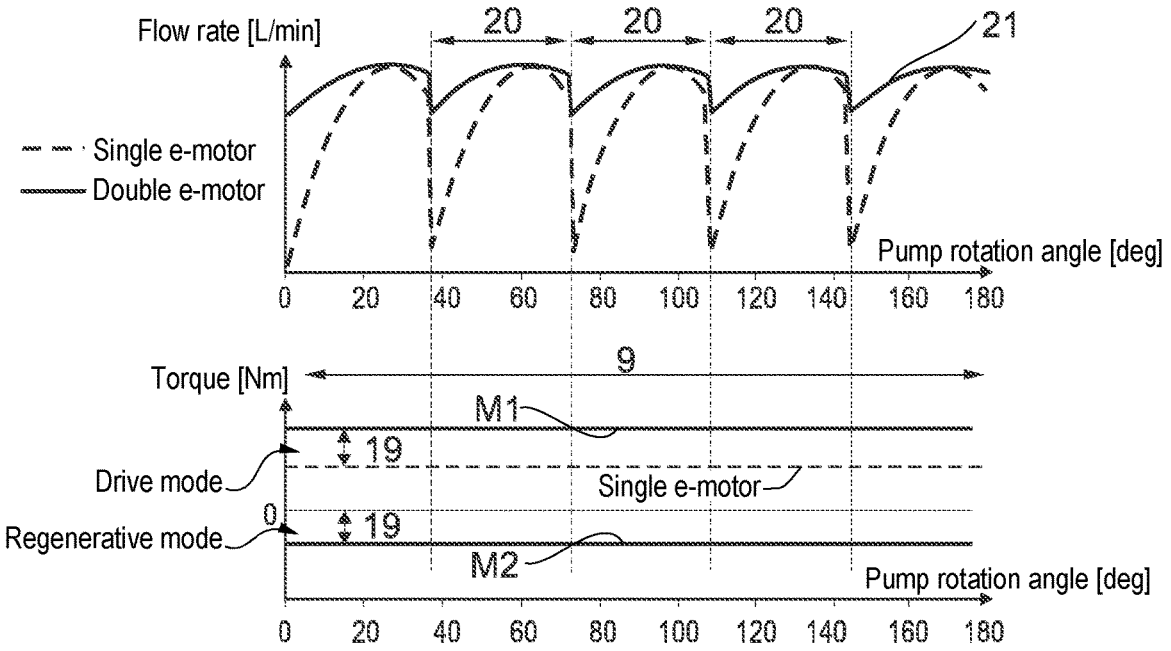
FIG. 8 illustrates schematically a diagram of a flow rate and the associated torque of the electric pump actuator in FIG. 7, and a first control method.

In the case of a conventional electric pump actuator 1' according to the prior art having a single electric motor/individual E-motor, as illustrated in the middle region of FIG. 7, in the case of defined rotation angles of the electric pump actuator, a leakage would occur, since the teeth of the first and the second gear wheel do not lie against one another here. If, conversely, the electric pump actuator 1 is operated and by means of the electronic control unit 8, for example via the control method in accordance with the disclosure, said electric pump actuator is controlled in such a manner that the first electric motor 6 is influenced with a first torque M1, and the second electric motor 7 is influenced with a torque M2, the force that results from the second torque M2 is set against any force that results from the first torque M1 in at least one rotation angle section 9 (ref. FIG. 8). The second gear wheel 5 is thus actively rotated in the region of the leakage against the first gear wheel 4 and the two teeth 18 of the gear wheels 4, 5 that are respectively in operative engagement, lie against one another and prevent a leakage. As is apparent in the upper diagram in FIG. 7, the flow rate 21, in the case of a pump actuator 1, remains stable and relatively constant, and a return flow, such as is the case in conventional electric pump actuators 1', may be avoided.

FIG. 8 again illustrates, in the upper part, the diagram in FIG. 7 and also, in the lower part, a corresponding control method for the electric pump actuator 1 of a first variant, according to which the ECU 8 influences the electric motors 6, 7 with the first torque M1 and the second torque M2. As already shown in FIG. 7, the two diagrams comprise a period 20 of 36°/36 degrees/36 deg. in which the graph periodically repeats. In the lower part of FIG. 8, it is apparent that the absolute value of the first torque M1 of the first electric motor 6 of the electric pump actuator 1 has been increased by a delta amount 19 with respect to the individual E-motor (conventional EPA according to the prior art), whereas the absolute value of the second torque M2 of the second electric motor 7 has also been increased by precisely this delta amount 19. The first electric motor 6 requires an accordingly higher power for the higher absolute value of the first torque M1, or the higher first torque M1, and operates in the drive mode, whereas, although the second electric motor 7 applies a specific torque M2, owing to the higher absolute value of the first torque M1 and the through-flow with the fluid, said second electric motor operates in a regenerative mode or generator mode and provides the electrical power that is generated by means of said regenerative or generator mode to the first electric motor 6. The control method therefore controls the first electric motor 6 and generates a constant absolute value of the first torque M1, while the second electric motor 7 is controlled in such a manner that this generates a constant absolute value of the torque M2, and the force that results from the second torque M2 counteracts any force resulting from the first torque. As is apparent in the diagram in the upper part in FIG. 8, the flow rate 21 is stabilized by means of the electric pump actuator 1 or the control method for an electric pump actuator.

Figure 9:
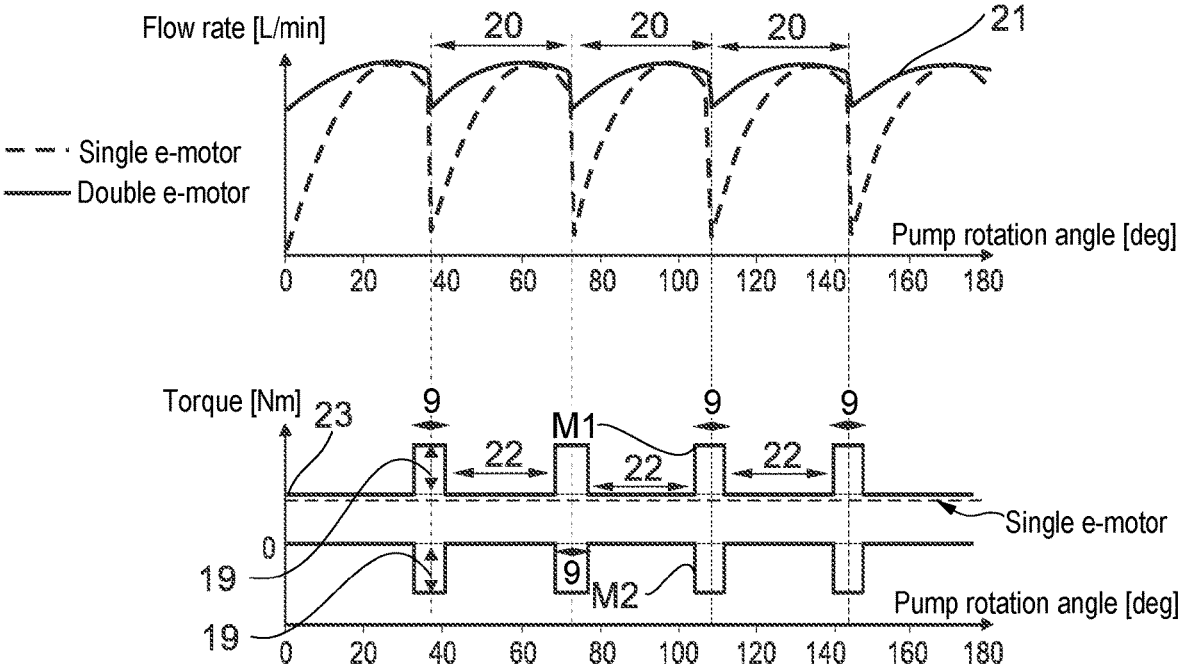
FIG. 9 illustrates schematically a diagram of an example embodiment of the electric pump actuator in which the electronic control unit controls the first and second electric motor with reference to a second preferred control method.

FIG. 9 illustrates an electric pump actuator 1 of a further embodiment or a control method for an electric pump actuator 1 according to a further (control) variant. In the first predetermined rotation angle ranges 22 of the gear wheels 4, 5 or the gear wheel pump 3, the first torque M1 is controlled in such a manner that said first torque adopts a constant absolute value 23, while, simultaneously, the second torque M2 adopts the value zero or the second electric motor 7 is passive. In the second predetermined second rotation angle ranges 9 of the gear wheels 4, 5, the first torque M1 adopts an absolute value that is greater than the constant absolute value 23 of the first predetermined rotation angle ranges 22, and the second torque M2 simultaneously adopts an absolute value that remains lower than the absolute value of the first torque M1 but is greater than the absolute value of the second torque M2 in the first rotation angle range 22. The delta amount 19 by which the electronic control unit 8 increases the constant absolute value 23 of the first torque M1 of the first predetermined rotation angle ranges 22 is identical to the delta amount 19 by which the absolute value of the second torque M2 is increased.

As a consequence, the electric pump actuator 1 may be operated in a similar manner to the conventional electric pump actuator 1' in the case of the first rotation angle ranges 22 having only the first electric motor 6 having a first torque M1 having the constant absolute value 23, and only in the second rotation angle ranges 9 or rotation angle sections 9 in which a leakage occurs, is an accordingly higher power or greater absolute value of the first torque M1 or higher first torque M1 and an associated higher absolute value of the second torque M2 of the second electric motor 7 controlled in order to efficiently prevent a return flow of the fluid (in this case oil) and in order to stabilize the electric pump actuator 1. This procedure, as is apparent in FIG. 9, is periodically repeated with the period 20 that is dependent upon the number of teeth 18 of the gear wheels 4, 5 of the gear wheel pump 3.

An operation of the electric pump actuator 1 is also conceivable in which in predetermined time sections the control is applied in accordance with FIG. 8 and in other time sections the control is applied in accordance with FIG. 9. Therefore the two control methods are combined in dependence upon time.

REFERENCE NUMERALS

1' Conventional electric pump actuator
1 Electric pump actuator
2 Continuously variable transmission
3 Gear wheel pump
4 First gear wheel
5 Second gear wheel
6 First electric motor
7 Second electric motor
8 Electronic control unit
9 Second rotation angle section/rotation angle range
10 Inverter
11 Battery
12 Direct current line
13 Alternating current line
14 Housing
15 Rotary axle
16 Shaft
17 Control line
18 Tooth
19 Delta amount/difference value
20 Period
21 Flow rate
22 First rotation angle section/rotation angle range
23 Constant absolute value
M1 First torque
M2 Second torque

The invention claimed is:

1. An electric pump actuator for a continuously variable transmission comprising:
- a gear wheel pump comprising:
  - a first gear wheel; and
  - a second gear wheel meshing with the first gear wheel;
- a first electric motor for actuating the first gear wheel;
- a second electric motor for actuating the second gear wheel independent of the first gear wheel; and
- an electronic control unit arranged to:
  - control the first electric motor such that the first electric motor applies a first torque to the first gear wheel; and
  - control the second electric motor such that the second electric motor operates as a generator such that the second electric motor applies a second toque to the second gear wheel that is set against the first torque in at least one rotation angle range so that fluid leakage is reduced or prevented between the first gear wheel and the second gear wheel.

2. The electric pump actuator of claim 1, wherein:
- the electronic control unit is arranged to control the first electric motor and the second electric motor such that a first absolute value of the first torque is greater than a second absolute value of the second torque; or the electronic control unit is arranged to control the first electric motor and the second electric motor such that:

the second absolute value is lower than the first absolute value in a first rotation angle range; and the first torque has a third absolute value greater than the first absolute value and the second torque has a fourth absolute value lower than the third absolute value and higher than the second absolute value in a second rotation angle range.

3. The electric pump actuator of claim 1, wherein:

the electronic control unit is arranged to control the first electric motor and the second electric motor such that:

a second absolute value of the second torque is lower than a first absolute value of the first torque in a first rotation angle range;

the first torque has a third absolute value greater than the first absolute value and the second torque has a fourth absolute value lower than the third absolute value and higher than the second absolute value in a second rotation angle range; and a first delta amount of an increase in the third absolute value from the first absolute value equals a second delta amount of an increase in the fourth absolute value from the second absolute value.

4. The electric pump actuator of claim 1, further comprising:

a first inverter for converting a direct current voltage into a first alternating current voltage and providing the first alternating current voltage to the first electric motor in a controlled manner via the electronic control unit; and a second inverter for converting the direct current voltage into a second alternating current voltage and providing the second alternating current voltage to the second electric motor in a controlled manner via the electronic control unit.

5. The electric pump actuator of claim 1, further comprising a third electric motor for actuating one of the first gear wheel or the second gear wheel.

6. The electric pump actuator of claim 1, wherein the first electric motor and the second electric motor are each motor-generators designed to convert mechanical energy into electrical energy in addition to converting electrical energy into mechanical energy.

7. A continuously variable transmission for a vehicle comprising the electric pump actuator of claim 1.

8. The electric pump actuator of claim 1, wherein the second electric motor is configured to provide electric power to the first electric motor in the at least one rotation angle range.

9. A control method for an electric pump actuator comprising:

providing a gear wheel pump comprising:

a first gear wheel driven by a first electric motor;

a second gear wheel driven by a second electric motor; and an electronic control unit for controlling the first electric motor and the second electric motor;

applying a first torque to the first gear wheel via the first electric motor; and applying a second torque to the second gear wheel via the second electric motor operating as a generator, wherein the second torque is set against the first torque so that fluid leakage is reduced or prevented between the first gear wheel and the second gear wheel.

10. The control method of claim 9, wherein:

absolute values of the first torque and the second torque are constant; or the absolute values of the first torque and the second torque vary over a rotation angle range.

11. The control method of claim 9, wherein:

absolute values of the first torque and the second torque vary over a rotation angle range; and a first delta amount by which an absolute value of the first torque is increased equals a second delta amount by which an absolute value of the second torque is increased.

12. The control method of claim 9, wherein the second electric motor is configured to provide electric power to the first electric motor.

* * * * *